United States Patent [19]

Knebel et al.

[11] Patent Number: 4,557,012

[45] Date of Patent: Dec. 10, 1985

[54] WIPER APPLIANCE

[75] Inventors: Michael Knebel, Zehnhausen; Rolf G. Schülein, Singhofen, both of Fed. Rep. of Germany

[73] Assignee: Leifheit AG, Nassau, Fed. Rep. of Germany

[21] Appl. No.: 615,510

[22] Filed: May 30, 1984

[30] Foreign Application Priority Data

May 30, 1983 [EP] European Pat. Off. ..... 83105319.4
Mar. 27, 1984 [EP] European Pat. Off. ..... 84103346.7

[51] Int. Cl.[4] ..... A47L 13/146
[52] U.S. Cl. ..... 15/116 R; 15/119 R
[58] Field of Search ..... 15/116 R, 116 A, 119 A, 15/119 R

[56] References Cited

U.S. PATENT DOCUMENTS 1,171,768 2/1916 Browning ..... 15/116 R
1,352,837 9/1920 Sanguinet ..... 15/119 R

FOREIGN PATENT DOCUMENTS 33830 11/1924 Denmark ..... 15/116 R

*Primary Examiner*—Edward L. Roberts
*Attorney, Agent, or Firm*—Frishauf, Holtz, Goodman & Woodward

[57] ABSTRACT

Wiper appliance with a pressure device arranged between wiper head and shaft with pressure plate and counter pressure plate which pressure device is actuated through the intermediary of a lever system, and with a traction device for the wiper cloth. In a second embodiment the housing includes a pressure plate which is guided by rocker levers, while the rocker levers are guided by catch bearing means integrally moulded on a transverse wall and on the pressure plate, while the rocker levers are integrally moulded on the pressure plate through the intermediary of film hinges.

25 Claims, 11 Drawing Figures

WIPER APPLIANCE

BACKGROUND OF THE INVENTION

The invention relates to a wiper appliance including a shaft to which a wiper element is attached and a pressure device for the wiper element.

One of the most unpleasant domestic activities is the wet wiping of floors. For this reason many attempts have already been made to facilitate this work for the housewife. Various appliances with a wringing device have been developed in order to prevent the hands from coming constantly into contact with the dirty water. For example, a sponge wiper appliance is known by German Utility Design 6,601,583, wherein the sponge support plate is divided and coupled to a mechanism which permits the two halves to be pressed against each other. It is thereby possible to absorb moisture from the floor and to force it out of the sponge again by pressing over a bucket. The high residual moisture content which remains is a disadvantage of this appliance.

A further wiper appliance with wringing mechanism has become known from British Pat. No. 777,512. This appliance operates with a wiper cloth and has a pressure roller device. In this case the residual moisture content is a function of the pressure force of the pressure roller; however, this is determined by the tearing strength of the wiper cloth. In fact, if the pressure roller is pressed too intensely it either becomes impossible to draw the wiper cloth through, or else it tears. The problem with this wiper appliance therefore lies in the fastening of the wiper cloth to the traction rod. In addition it is necessary to exert force in order to draw the wiper cloth through the pressure rollers. Moreover, no satisfactory work support for the wiper cloth is present.

SUMMARY OF THE INVENTION

The aim of the invention is to develop a wiper appliance in which a wiper cloth of the conventional type, that is to say similar to operating a scrubber with wiper cloth, is used, while this wiper cloth can be brought together with a pressure device.

The wiper cloth is positively guided by means of the traction device, so that it is extended on a wide surface as far as the sides of the wiper head for wiping and is gathered together for pressing. The pressing operation commences only after the wiper cloth has been drawn into the pressing device. Consequently no inadmissibly high tensile stresses are applied to the wiper cloth. A sufficiently high degree of dryness can be achieved by the laminar pressure device due to the gathering together of the wiper cloth.

The actuation of the pressure plates through a multiple lever system reduces the actuating forces to a comfortable level for the housewife despite a high pressure force. Drainage means in the pressure plates serve to increase the degree of dryness. The particular construction of the traction device with the flexible rod serves for reliable guidance of the wiper cloth.

In one embodiment, aesthetically attractive external design is achieved by constructing the guide means as a square tube.

In a second embodiment, the number of components is substantially reduced and the possibility of error during assembly is diminished.

For example, due to the bracing of the cover part by bars or webs on the lateral walls of the housing, the pressure forces can be absorbed very reliably, and screw or rivet connections between housing and cover part relieved.

The connection of the rocker lever by film hinges to the pressure plate, and the special construction of the rocker lever with a stop limiting bar, achieves a further simplification of assembly. The production of the pressure plate can be effected in one operation conjointly with the rocker levers with only one injection moulding tool. Naturally, depending upon the construction of the housing, the rocker levers may be integrally moulded on the cover part by film hinges in equivalent manner.

BRIEF DESCRIPTION OF THE DRAWING

Above-mentioned and other features and objects of this invention will become more apparent by reference to the following description taken in conjunction with the accompanying drawings, in which.

DETAILED DESCRIPTION OF THE PREFERRED EMBODIMENTS

Figure 1:
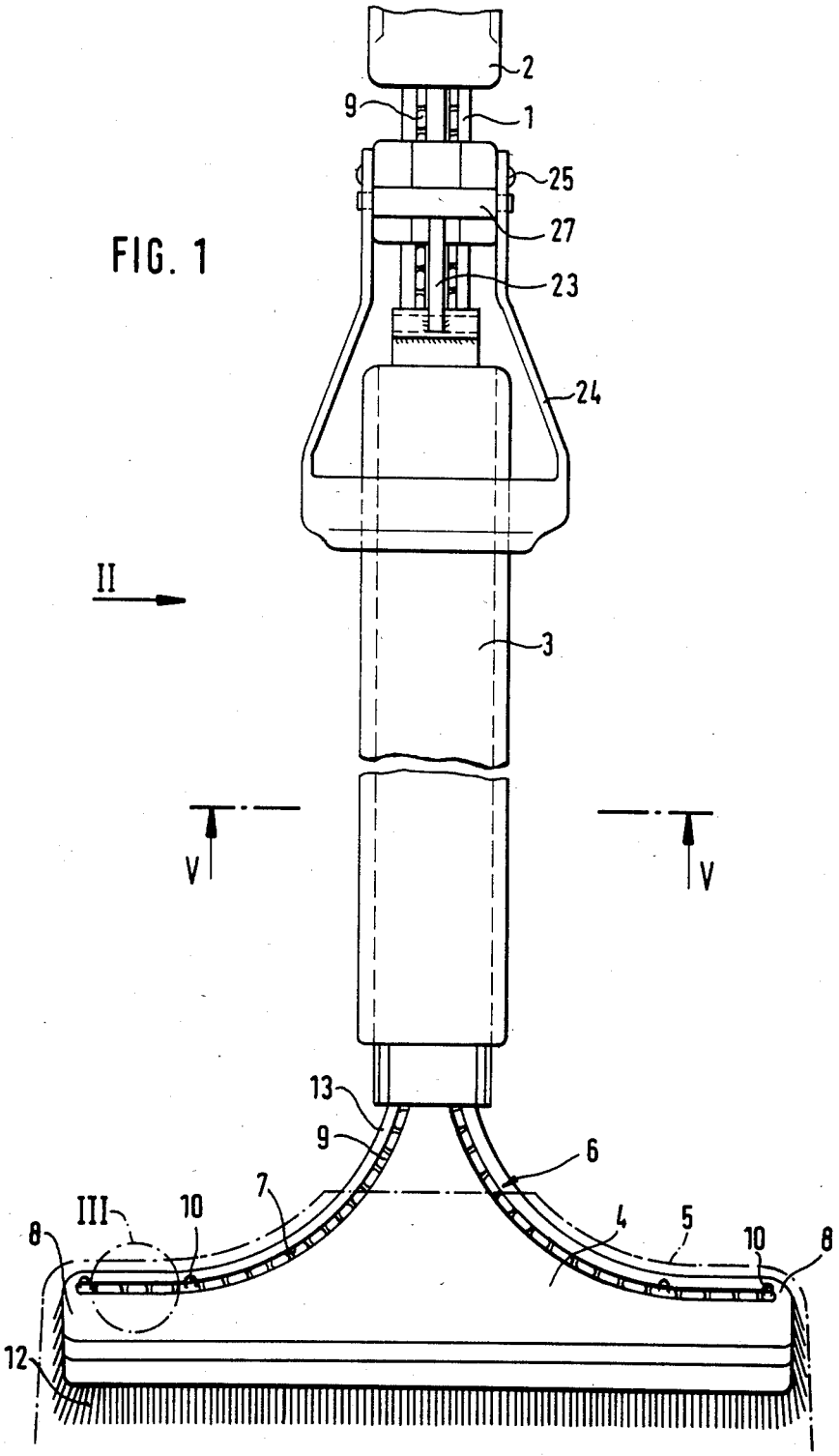
FIG. 1 shows a plan of a wiper appliance with wiper cloth indicated by chain-dotted lines, according to the first embodiment.
Figure 2:
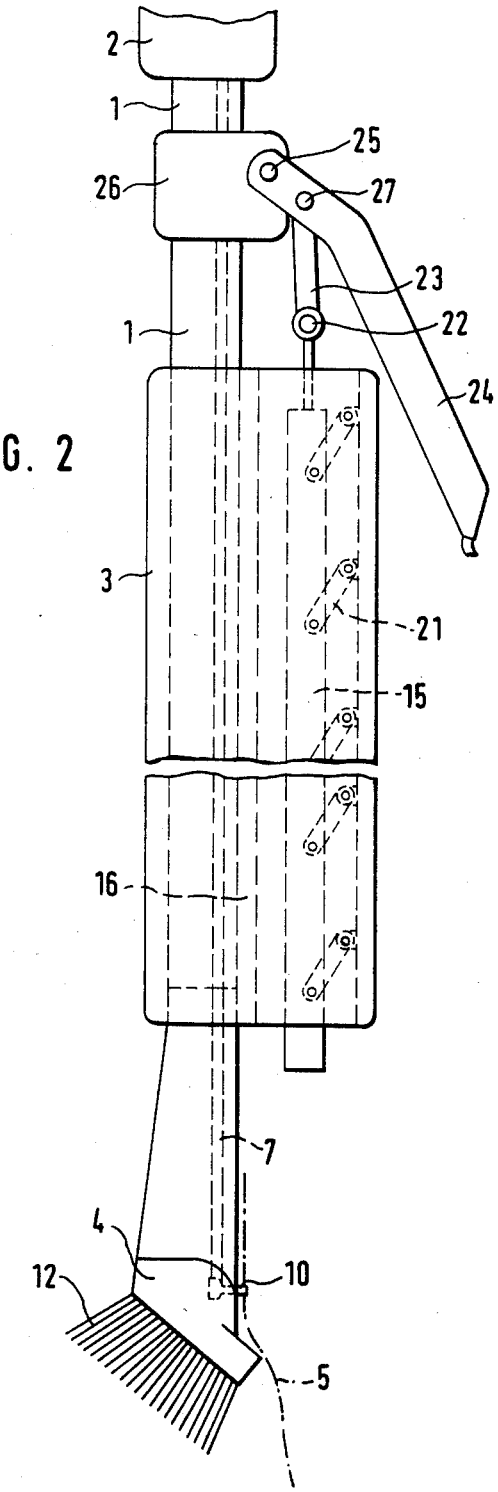
FIG. 2 shows a side elevation in direction II in FIG. 1.

In a first embodiment of the invention, the wiper appliance substantially comprises a shaft 1, a traction handle 2, a pressure device 3, a wiper head 4 with wiper cloth 5 and a traction device 6.

Figure 3:
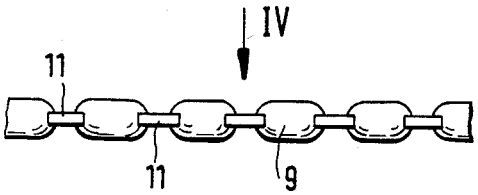
FIG. 3 shows, on a larger scale, a detail of the rod according to the circle III in FIG. 1.
Figure 4:
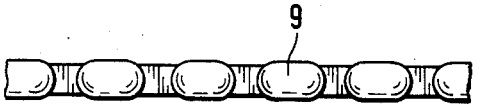
FIG. 4 shows a view in direction IV in FIG. 3.
Figure 5:
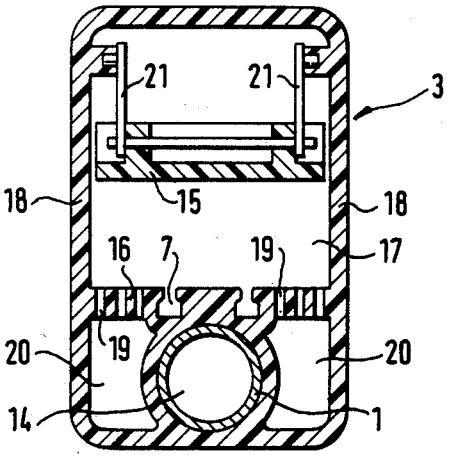
FIG. 5 shows a section made along the line V—V in FIG. 1.
Figure 6:
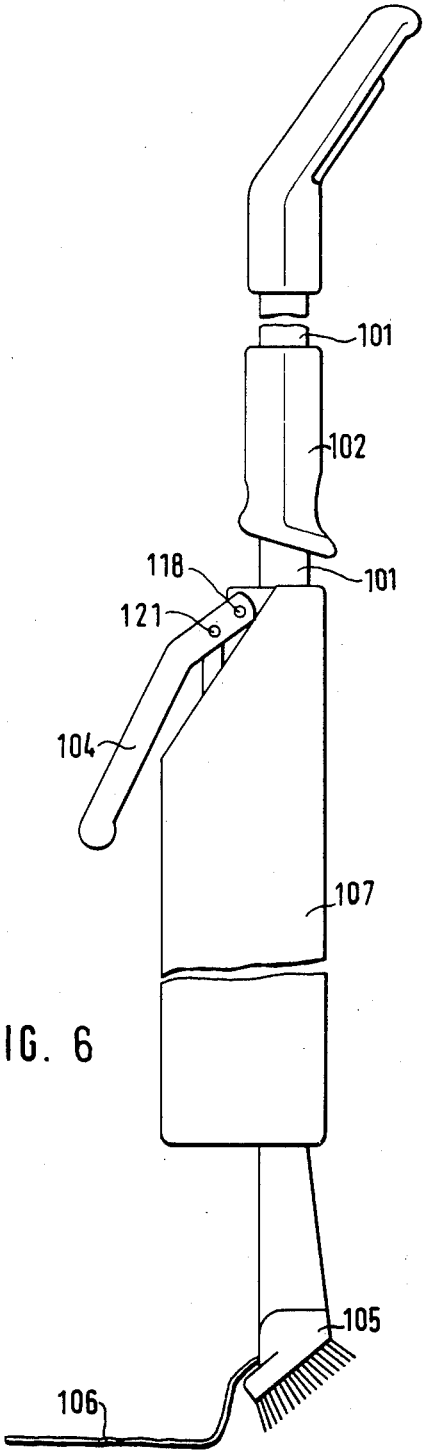
FIG. 6 shows a general view of a wiper appliance, according to the second embodiment.
Figure 7:
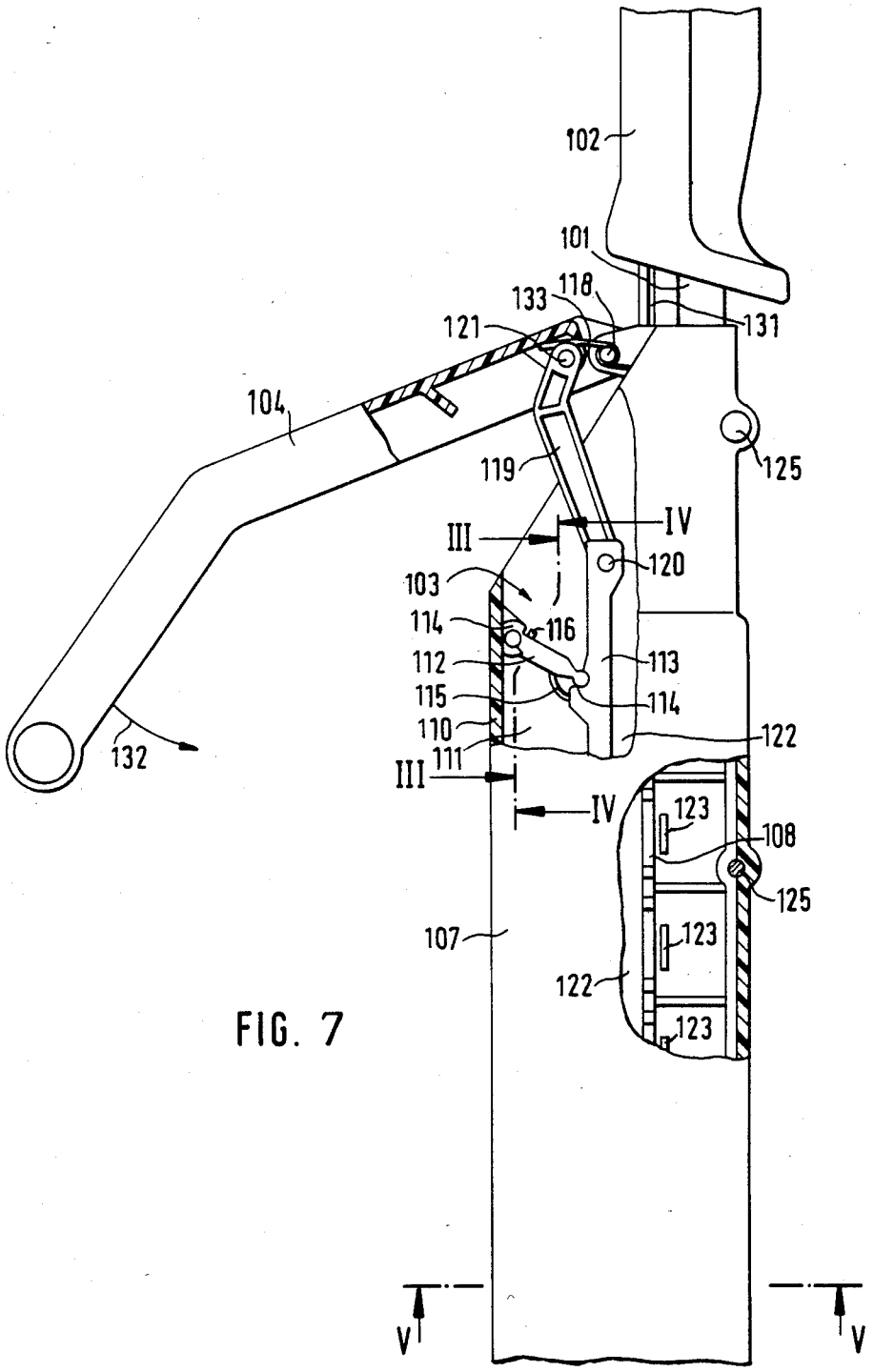
FIG. 7 shows the housing with traction lever, pressure plate and rocker level partly in section, of FIG. 6
Figure 8:
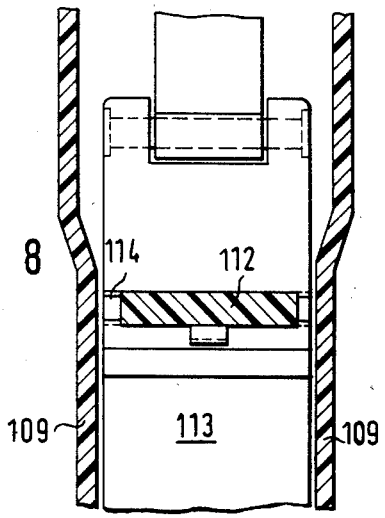
FIG. 8 shows a view in direction III—III in FIG. 7.
Figure 9:
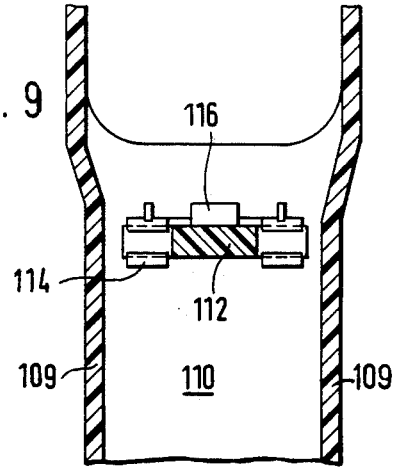
FIG. 9 shows a view along the line IV—IV in FIG. 7.
Figure 10:
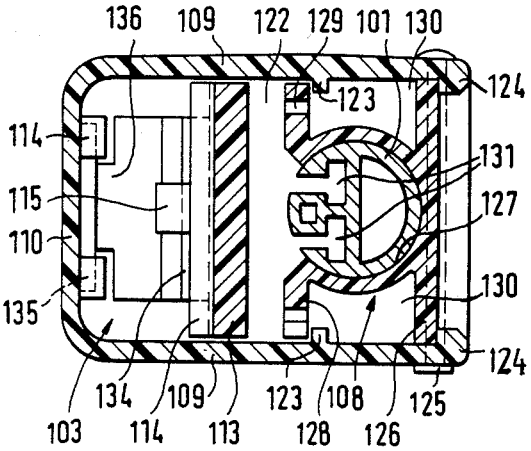
FIG. 10 shows a view along the line VI—VI in FIG. 7.

This traction device 6 is formed by two grooves 7 of tee-shaped cross-section, which extend arcuately from the lateral ends 8 in the wiper head 4 into the pressure device 3 and through the latter and are continued in the shaft 1, rods 9 guided in these grooves 7 and the traction handle 2. Fastening projections 10 for the wiper cloth 5 are moulded on the rods 9 in the region of the wiper head 4. The rods 9 are provided with notches 11. The profile of the rod is illustrated in FIGS. 3 and 4.

The wiper head 4 is provided with bristles 12 after the manner of a scrubbing brush on the side remote from the wiper cloth 5.

The pressure device 3 starts at the transitional region 13 between wiper head 4 and shaft 1. It is provided with a bore 14, into which the shaft 1 is inserted from the one side and the wiper head 4 from the other side. The pressure device 3 is constructed as a square tube. The pressure chamber 17 for the wiper cloth is formed conjointly with a pressure plate 15 and with a counter pressure plate 16. The lateral walls 18 form the guide means for the wiper cloth. The counter pressure plate 16 is provided with a drainage means 19, which leads into water discharge channels 20. The pressure plate 15 is suspended from the lateral walls 18 by rocker levers 21.

The pressure plate 15 is connected, through the intermediary of a traction rod 23 divided by an articulation 22, to a single-armed traction lever 24. The traction lever 24 is mounted on the shaft 1 through the intermediary of the pivot axis 25 and with interposition of a retaining bracket 26. The traction rod 23 is articulated to the traction lever 24 in the pivot joint 27.

The operative position of the wiper appliance, that is, the wiping position, is illustrated in the drawings. Only the pressure plate 15 is shown raised slightly for better comprehension. Now when water has been absorbed from the surface to be cleaned by the wiper cloth 5, the wiper cloth is drawn into the pressure device by means of the traction handle 2, which is mounted with axial sliding mobility on the shaft 1. The fastening projections 10 then travel inwards and therefore automatically fold the wiper cloth 5. The latter is drawn totally into the pressure chamber 17. After this, by actuating the traction lever 24, the pressure plate 15 is pressed towards the counter pressure plate 16. The wiper cloth 5 is wrung out, the liquid can escape out of the pressure device via the drainage means 19 and water discharge channels 20.

In a second embodiment of the invention, referring to FIGS. 6–11, the wiper appliance consists substantially of a shaft 101, a traction handle 102, a pressure device 103 with traction lever 104, a wiper head 105 with wiper cloth 106 and a traction device, not shown in detail, for drawing the wiper cloth 106 into the pressure device 103. The structure of the traction device is the same as that described above.

Figure 11:
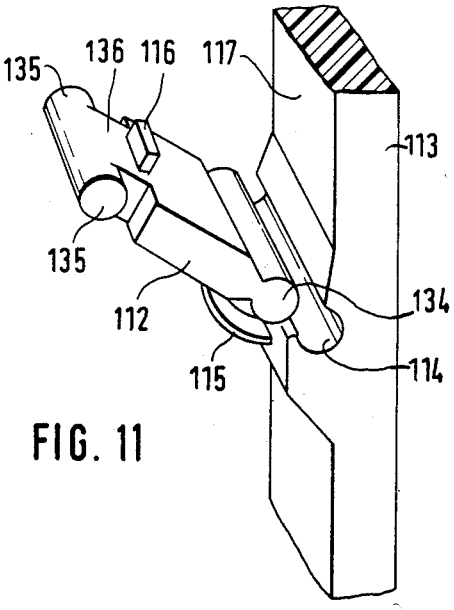
FIG. 11 shows, in perspective, a rocker lever of the second embodiment with a piece of the pressure plate in a state of removal from the injection moulding tool.

The principal elements of the pressure device 103 are accommodated in a U-shaped housing 107. A counter-pressure plate 108 serves as a cover part to close this housing 107. The pressure chamber 111 is formed by the counter-pressure plate 108, lateral walls 109 and a transverse wall 110. This pressure chamber 111 contains a pressure plate 113 mounted by means of rocker levers 112 on the transverse wall 110. Catch bearing means 114 are moulded integrally both on the transverse wall 110 and on the pressure plate 113. The rocker levers 112 are clipped into these catch bearing means 114. The rocker levers 112 are further connected by the film hinge 115 to the pressure plate 113. FIG. 11 shows the state in which the component leaves the injection mould. A stop limiting bar 116 is also moulded integrally on the rocker lever 112. This stop limiting bar 116 serves on the one hand as an assembly aid, during assembly it abuts the surface 117 of the pressure plate 113, and also as a dead centre limiting stop. By this means, the pressure plate 113 is prevented from possibly reaching a dead centre position relative to the traction lever 104. The stop limiting bar 116 strikes against the catch bearing means 114 on the transverse wall 110 before the dead centre position is reached in the pressing state, and against the surface 117 in the relaxed state.

The pressure plate 113 is actuated by the traction lever 104. The traction lever 104 is mounted on the housing 107 by pivot axis 118. The traction lever 104 is further connected to the pressure plate 113 through the intermediary of a traction rod 119. The articulation of the traction rod occurs through a joint 120 on the pressure plate 113 and through a pivot joint 121 on the traction lever 104.

The actual guide chamber 122 for the wiper cloth 106 is formed between the pressure plate 113 and the counter pressure plate 108. The counter pressure plate 108 is retained on the lateral walls 109 of the housing 107 by webs 123 and two bars 124 and is secured by rivets 125.

The pressure plate 108 consists of a foot 126 located tightly in the housing 107, a channel 127 to accommodate the shaft 101, and the wiper cloth support 128. The wiper cloth support 128 is provided with a drainage means 129 which leads into the discharge ducts 130. The discharge ducts 130 are formed by the foot 126, the lateral walls 109, the walls of the channel 127 and the wiper cloth support 128.

The grooves 131 in the shaft 101 receive the rods of the traction device.

A spring 133 is arranged round the pivot axis 118 in order to keep open the guide chamber 122, for which purpose the traction lever 104 must be guided in the direction of the arrow 132.

The operation of the pressure device 103 is performed as follows. First of all the rocker levers 112 are pressed with the roller foot 134 into the catch bearing means 114 of the pressure plate 113. Then the pressure plate 113 is guided towards the transverse wall 110 until the rocker levers 112 abut with the stop limiting bars 116 against the surfaces 117. Only then are the stub axles 135 of the rocker levers 112 pressed into the catch bearing means 114 of the transverse wall 110. The catch bearing means 114 of the transverse wall 110 are divided, so that the neck 136 of the rocker levers 112 can pivot freely.

While I have described above the principles of my invention in connection with specific apparatus, it is to be clearly understood that this description is made only by way of example and not as a limitation to the scope of my invention as set forth in the objects thereof and in the accompanying claims.

We claim:

1. A wiper appliance comprising:

a shaft;

wiping means positioned at one end of the shaft;

a pressure device positioned on the shaft for removing liquid from said wiping means, said pressure device including a chamber, a pressure plate movably positioned in said chamber, a counter pressure plate, and means for moving said pressure plate into and out of engagement with said counter pressure plate; and traction means for conveying a portion of said wiping means into and out of said chamber of said pressure device and being movable along said shaft, said traction means conveying said wiping means to a position between said pressure plate and said counter pressure plate in said chamber, whereby said pressure plate is movable into engagement with said counter pressure plate with said wiping means therebetween to press said wiping means to remove liquid therefrom.

2. The wiper appliance as in claim 1 wherein said pressure device further includes guide means for guiding said traction means located in at least said counter pressure plate.

3. The wiper appliance as in claim 2 wherein said guide means comprises ducts extending along the length of said counter pressure plate.

4. The wiper appliance as claimed in claim 2 wherein said pressure plate and said counter pressure plate are both substantially flat, and wherein said guide means comprises at least one elongated recess in said counter pressure plate for receiving and guiding at least a portion of said traction means and for guiding said wiping means into said chamber.

5. The wiper appliance as in claim 1 wherein at least said counter pressure plate comprises means for draining liquid released by said pressure device.

6. The wiper appliance as in claim 1 wherein said wiping means includes a wiper head and a wiper cloth positioned adjacent said wiper head, said wiper cloth being detachably secured to said traction means.

7. The wiper appliance as in claim 6 wherein said traction means includes a handle slidably positioned on the other end of said shaft, at least two flexible rods, and guide tracks in said wiper head, each of said rods being attached at one end to said handle and extending through a respective one of said guide tracks and said rods each being connected at the other end to said wiping means, said rods being mounted in said guide tracks along which said rods are movable.

8. The wiper appliance as in claim 7 wherein each of said rods is resilient along its length in the area of the wiper head and substantially rigid along its remaining length.

9. The wiper appliance as in claim 7 wherein each of said rods has notches extending in a direction perpendicular to its length.

10. The wiper appliance as in claim 7 wherein each of said rods includes fastening means for attachment of the wiper cloth to said rods.

11. The wiper appliance as in claim 6 wherein the wiper head includes brush means.

12. The wiper appliance as in claim 1 wherein said traction means includes a traction handle movably attached to said shaft, a traction rod pivotally attached between said traction handle and said pressure plate, and at least one rocker lever pivotally mounted at one end on an inner wall of said chamber and at the other end on said pressure plate for transferring vertical movement of the handle into vertical and lateral movement of the pressure plate to cause engagement of said pressure plate with said counter pressure plate.

13. The wiper appliance as in claim 12 wherein said counter pressure plate includes an opening through which said shaft extends and grooves for guiding said traction means.

14. The wiper appliance as in claim 1 wherein said pressure device includes an elongated U-shaped structure having an open portion, said pressure plate being movably positioned therein, and said counter pressure plate being positioned in said U-shaped structure so as to cover the open portion thereof.

15. The wiper appliance as in claim 14 wherein said U-shaped structure includes means for retaining said counter pressure plate in position.

16. The wiper appliance as in claim 14 wherein said traction means includes a traction handle movably attached to said shaft, a traction rod pivotally attached between said traction handle and said pressure plate and at least one rocker lever pivotally mounted at one end on an inner wall of said U-shaped structure and at the other end to said pressure plate by means of a hinge film.

17. The wiper appliance as in claim 16 wherein said at least one rocker lever includes means for limiting the movement of the lever.

18. The wiper appliance as in claim 14, wherein said pressure device further includes guide means for guiding said traction means, said guide means being located in at least said counter pressure plate.

19. The wiper appliance as in claim 14 wherein said pressure plate and said counter pressure plate are both substantially flat.

20. The wiper appliance as in claim 1, wherein said traction means includes a handle slidably positioned on the other end of said shaft, at least two flexible rods, and guide tracks in said wiping means, each of said rods being attached at one end to said handle and extending through a respective one of said guide tracks, and each of said rods being connected at the other end to said wiping means, said rods being mounted in said guide tracks along which said rods are movable.

21. The wiper appliance as in claim 20 wherein each of said rods is resilient along its length in the area of the wiping means and substantially rigid along its remaining length.

22. The wiper appliance as in claim 20 wherein each of said rods includes fastening means for attachment of a wiper cloth to said rods.

23. The wiper appliance as in claim 20, wherein said guide tracks have a curved region, and said rods are resilient in the direction of curvature for at least a length which corresponds to said curved region of said guide tracks, and are of substantially rigid construction in the direction at right angles thereto.

24. The wiper appliance as in claim 23, wherein said wiping means includes a wiping cloth releasably fastened to said rods.

25. The wiper appliance as in claim 1 wherein said pressure plate and said counter pressure plate are both substantially flat.

* * * * *